US008403517B1

(12) United States Patent
Cox et al.

(10) Patent No.: US 8,403,517 B1
(45) Date of Patent: Mar. 26, 2013

(54) LUMINESCENT GOLF BALL RECHARGING APPARATUS

(76) Inventors: Randy E. Cox, Cincinnati, OH (US); Randall A. Vayo, Cincinnati, OH (US)

( * ) Notice: Subject to any disclaimer, the term of this patent is extended or adjusted under 35 U.S.C. 154(b) by 246 days.

(21) Appl. No.: 12/858,455

(22) Filed: Aug. 18, 2010

(51) Int. Cl.
*F21V 33/00* (2006.01)
*C09K 11/00* (2006.01)
*F21L 4/08* (2006.01)

(52) U.S. Cl. ..... 362/154; 362/84; 362/183; 362/234; 206/315.9

(58) Field of Classification Search ..... 362/154, 362/156; 206/315.9, 315.1, 315.2; 224/918, 224/919
See application file for complete search history.

(56) References Cited

U.S. PATENT DOCUMENTS 3,831,001 A 8/1974 Toomey et al.
3,937,320 A 2/1976 Chao et al.
3,938,132 A 2/1976 Cunningham
4,927,015 A 5/1990 Jones
5,311,413 A * 5/1994 Farmer et al. ..... 362/154
5,671,539 A * 9/1997 Barone ..... 42/145
6,267,484 B1 7/2001 Baker et al.
6,298,841 B1 10/2001 Cheng
7,040,308 B2 * 5/2006 Ciesiun ..... 124/47
7,089,698 B2 8/2006 Afshari
7,252,401 B1 * 8/2007 Plaszcz ..... 362/84
7,870,851 B2 * 1/2011 Mahany ..... 124/56

* cited by examiner

*Primary Examiner* — Alan Cariaso
(74) *Attorney, Agent, or Firm* — Montgomery Patent & Design LLC; Robert C. Montgomery

(57) ABSTRACT

A recharging apparatus for luminescent golf balls comprising an outer housing capable of containing and simultaneously recharging a plurality of luminescent golf balls is herein disclosed. The housing comprises an internal cavity, a lid, and a battery powered internal illumination source. The illumination source is provided in vertical rows disposed on inner surfaces of the inner cavity to provide a recharging light to the golf balls contained within. The illumination source preferably comprises a plurality of light-emitting diodes (LED's) positioned behind light-diffusing inner walls.

14 Claims, 4 Drawing Sheets

LUMINESCENT GOLF BALL RECHARGING APPARATUS

RELATED APPLICATIONS

The present invention was first described in a notarized Official Record of Invention on Sep. 28, 2009, that is on file at the offices of Montgomery Patent and Design, LLC, the entire disclosures of which are incorporated herein by reference.

FIELD OF THE INVENTION

The present invention relates generally luminescent golf balls, and in particular, to a luminescent golf ball recharging apparatus.

BACKGROUND OF THE INVENTION

Photo luminescent golf balls are seeing increased usage on golf courses across the country. Their glow-in-the-dark ability allows golfers to golf later in the day and even into dusk and nighttime hours. Additionally, their self-luminescent qualities provide an interesting effect as the ball travels through the air, as well as providing the useful function of allowing golfers to easily find a golf ball when it lands. However, for these golf balls to operate at their peak efficiency they must be fully recharged by placing them in a direct bright light. Ironically, it is the lack of this bright light as the reason why golfers are using them in the first place.

Various carriers exist for the purpose of conveniently carrying and organizing a number of golf balls. Typically these carriers include a case having an accessible interior portion, a lid, and a carrying handle. The golf balls are either positioned horizontally or stacked vertically within the case. However, these carriers do not contemplate providing an integral light source intended to recharge and activate the photoluminescent materials embedded into the cover of the golf balls.

Examples of these types of storage cases can be seen by reference to several U.S. patents. U.S. Pat. No. 3,831,001, issued in the name of Toomey et al., discloses a golf ball heating device which includes a closable case having a heat conductive tray for receiving golf balls and an electrical resistance heating element to heat the golf balls residing within the tray.

Various other storage containers for use with other articles also exist, as can be seen by example in U.S. Pat. No. 3,937,320, issued in the name of Chao et al., which discloses a lighted jewelry box and U.S. Pat. No. 3,938,132, issued in the name of Cunningham, which discloses an illuminated fishing tackle box.

U.S. Pat. No. 4,927,015, issued in the name of Jones, discloses luminous golf balls and a carrying case therefore which provides a light source disposed in an upper chamber of the case, a light-reflective material lining the upper chamber, and a power supply for the light source for activating the luminescent golf balls.

While these devices may accomplish their specific intended purpose, each suffers from one (1) or more disadvantage or deficiency with respect to design, function, or effectiveness. In particular, these devices fail to contemplate providing light for purpose of recharging luminescent golf balls for use during play. Additionally, the light provided may not be sufficient to properly charge the golf balls if used and are not easily portable for convenient transport and use during play on a gold course.

Accordingly, there exists a need for a means by which photo luminescent golf balls can be easily and completely recharged right up to the point of use. The development of the present invention substantially departs from the conventional solutions and in doing so fulfills this need.

SUMMARY OF THE INVENTION

In view of the foregoing references, the inventor recognized the aforementioned inherent problems and lack in the art and observed that there is a need for a device which provides for the transportation and recharging of a plurality of luminescent golf balls. Thus, the object of the present invention is to solve the aforementioned disadvantages and provide for this need.

Another object of the present invention is to provide an apparatus which recharges the luminescent golf balls with a high intensity light which has utilizes a low consumption of power.

Yet another object of the present invention is to provide an apparatus which ensures the luminescent golf balls are the brightest they can be up to the point of use.

Yet another object of the present invention is to provide an apparatus which can hold at least one and up to six luminescent golf balls.

Yet still another object of the present invention is to provide an apparatus which is easily carried on a golf cart or golf bag carrier.

Yet still another object of the present invention is to provide an apparatus which is simple and intuitive to use.

Yet still another object of the present invention is to provide an apparatus which is durable and economical to manufacture.

One (1) or more of these and other objects of the invention are achieved by providing a luminescent golf ball recharging apparatus comprising a generally cylindrical housing including an open top for receiving luminescent golf balls, an upper cavity for containing the golf balls, a lower cavity for containing the functioning electrical components of the apparatus, a thin planar floor panel for separating the upper cavity and the lower cavity, and a closed bottom. A planar lid is provided which is pivotally attached to an upper edge of the open top. A plurality of lamps is disposed on an interior of the upper cavity for providing illumination to the upper cavity. A removable battery is disposed within the lower cavity which is in electrical communication with the plurality of lamps for powering the plurality of lamps. The housing closed bottom also includes a removable battery cover for accessing the battery. A switch is disposed on an exterior of the lower cavity which is in electrical communication between the plurality of lamps and the battery for activating the plurality of lights. The illumination provided by the lamps is absorbed by a photoluminescent material embedded within the surface of the golf balls.

In at least one embodiment of the apparatus, these objects are achieved by providing the upper cavity having an inner wall portion comprised of a light-diffusing translucent material for distributing the illumination from the plurality of lamps. The plurality of lamps is disposed behind said inner wall portion.

Furthermore, the described features and advantages of the invention may be combined in various manners and embodiments as one skilled in the relevant art will recognize. The invention can be practiced without one (1) or more of the features and advantages described in a particular embodiment.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
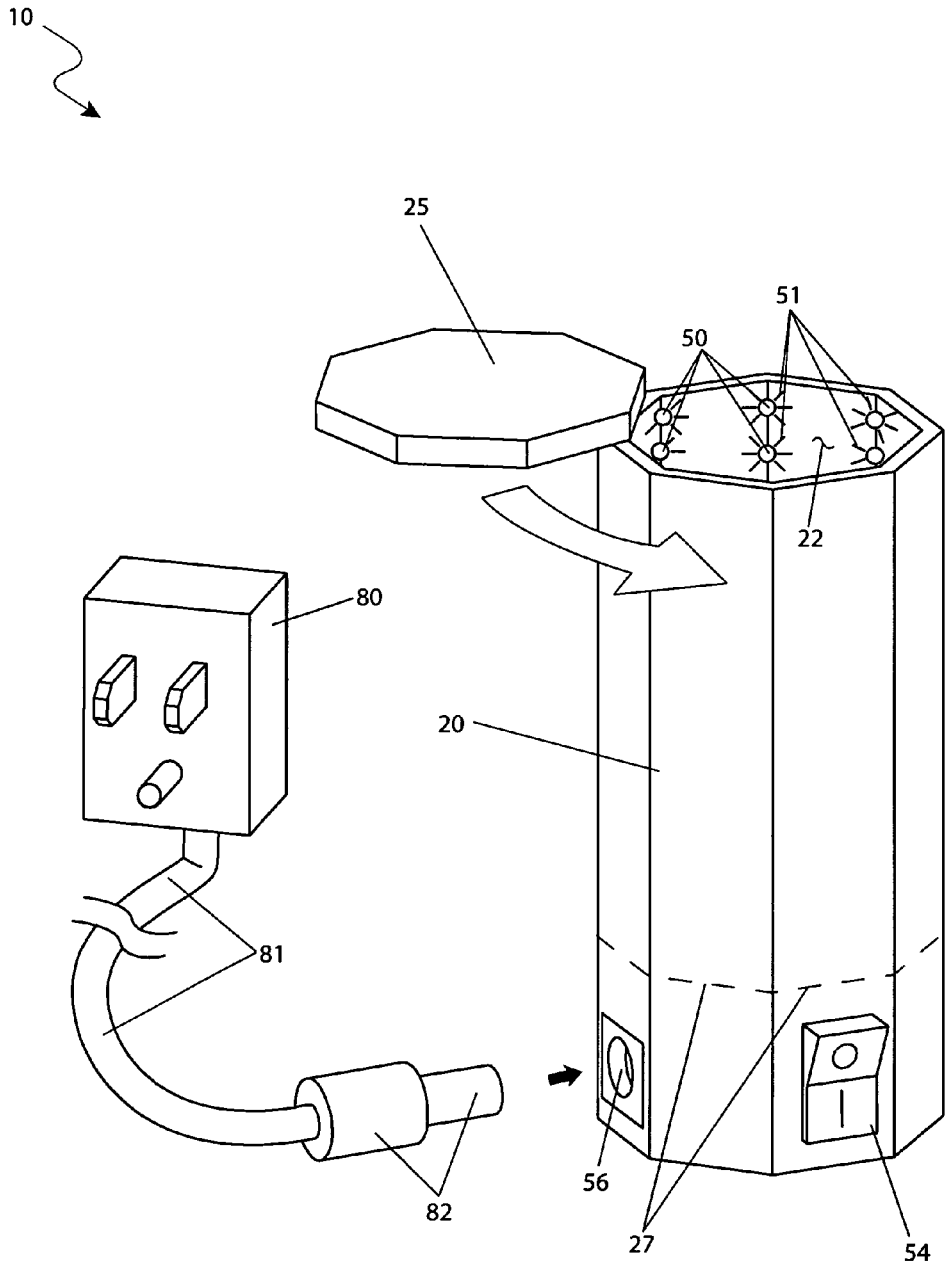
FIG. 1 is a front perspective view of a luminescent golf ball recharging apparatus 10, according to a preferred embodiment of the present invention.

10 luminescent golf ball recharging apparatus
20 housing
22 upper cavity
25 lid
26 post feature
27 floor
28 lower cavity
30 inner wall
50 lamp
51 illumination
52 battery
540N/OFF switch
56 direct current (DC) receptacle
60 terminal strip
62 battery connector
65 battery access cover
80 power transformer
81 power cord
82 transformer plug
100 golf ball
110 wiring
120 duplex outlet

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a luminescent golf ball recharging apparatus (herein described as the "apparatus") 10, which provides a structure for receiving and recharging at least one luminescent golf ball 100 and a method of use thereof.

Figure 2:
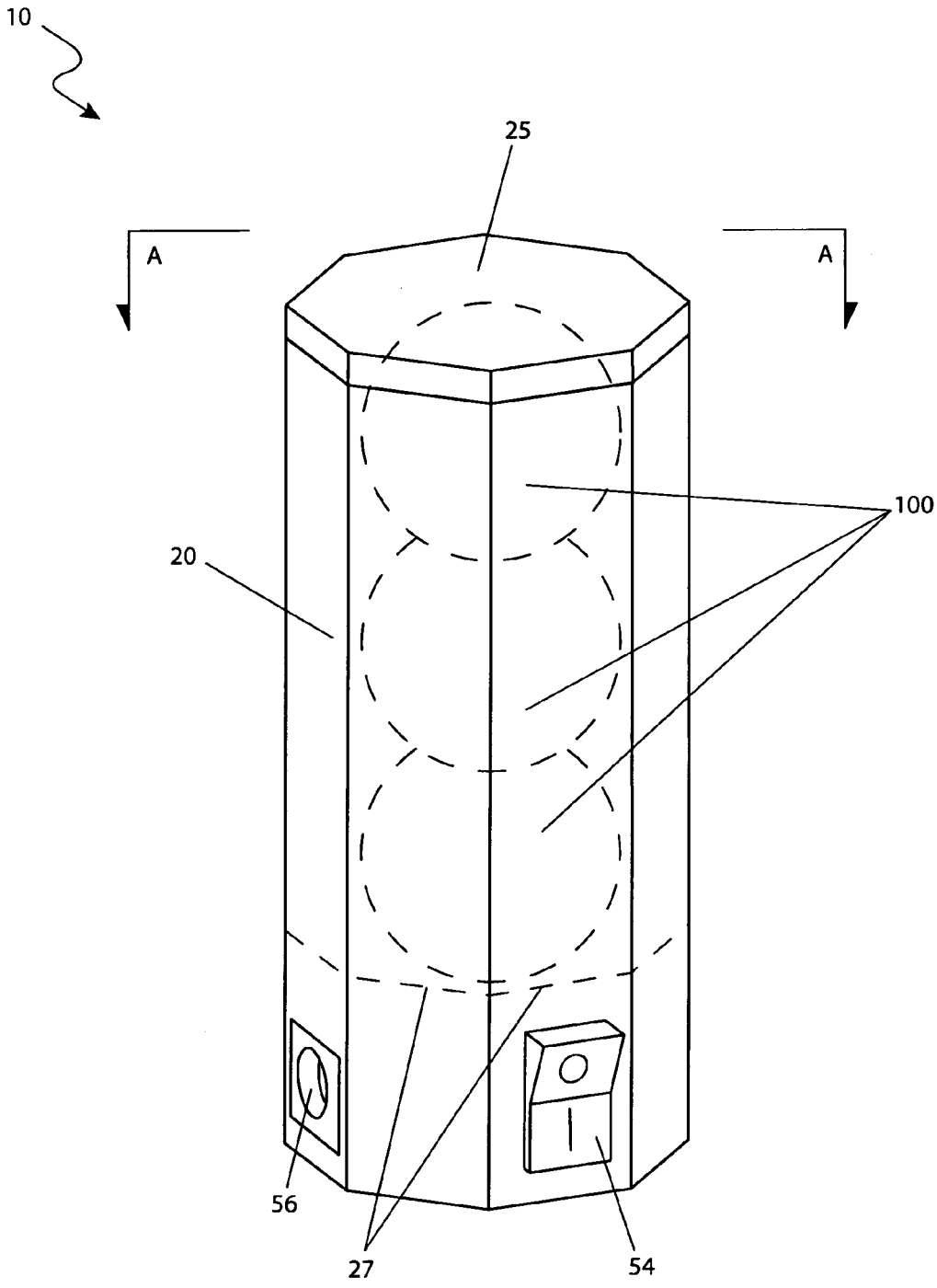
FIG. 2 is a front perspective view of the luminescent golf ball recharging apparatus 10 depicting a closed state, according to a preferred embodiment of the present invention.

Referring now to FIGS. 1 and 2, front perspective views of the apparatus 10 depicting closed and open states, according to the preferred embodiment of the present invention, are disclosed. The apparatus 10 comprises a housing 20, a lid 25, a plurality of illuminating lamps 50. The plurality of lamps 50 are powered by an internal rechargeable or disposable battery 52. The housing 20 generally comprises a relatively cylindrical shape having a longitudinal length and a transverse cross-section. The transverse cross-section and lid 25 can be provided in various preselected geometric shapes such as a square, a circle, a hexagon, or the like. The preferred embodiment of the housing 20, as depicted here, comprises. However, it is understood that the housing 20 and lid 25 may be provided having various different geometric shapes which provide equal function and as such should not be interpreted as a limiting factor of the apparatus 10.

The housing 20 is preferably approximately seven (7) inches tall with the horizontally sliding lid 25 having a matching octagonal perimeter edge. To insert the golf balls 100 within the housing 20 and to access the golf balls 100 once charged, the lid 25 is pivotably motioned across an open top surface of the housing 20 in a parallel manner. The lid 25 is pivotably attached to an upper perimeter edge of the open top of the housing 20, preferably by use of a mechanical fastening interference. The housing 20 further comprises an inner upper cavity 22 suitably sized to securely contain a plurality of luminescent golf balls 100 which are stacked vertically upon each other. Rotating the lid 25 in a sideways direction provides access to the upper cavity 22. The housing 20 and lid 25 are envisioned to be made using rugged plastic materials being provided in a variety of colors, patterns, and attractive logos based upon a user's preference.

The plurality of illuminating lamps 50 are arranged in vertical rows linear aligned along seven (7) inside corners of the octagonal housing 20, thereby providing illumination 51 within the upper cavity 22 directed toward the golf balls 100 contained inside. The lamps 50 are contained behind a transparent or translucent light-diffusing inner wall portion 30 of the upper cavity 22, thereby evenly distributing produced illumination 51 while avoiding direct contact between the golf balls 100 and the lamps 50. The lamps 50 are preferably light-emitting diodes (LED's) capable of recharging the photoluminescent material contained in the surface of "glow-in-the-dark" style golf balls 100; however, other miniature lamp technologies may be utilized without deviating from the concept and as such should not be interpreted as a limiting factor of the apparatus 10. The bottom surface of the housing 20 comprises a battery access cover 65 for allowing easy installation and replacement of the battery 52. The battery 52 is envisioned to be a rechargeable or a disposable 9-volt DC unit. If a rechargeable-type battery 52 is installed in the apparatus 10, it may be recharged via a standard wall-plug type AC/DC power transformer unit 80 comprising a cord 81 and a male plug 82 which is to be removably attached to a mating female DC receptacle portion 56 of the housing 20 located along a lower side surface. The housing 20 also provides an ON/OFF switch 54 along a lower outer surface. The ON/OFF switch 54 is illustrated here being a common rocker-type device; however, various other two-position switches may be used such as toggle switches, push buttons, sliding switches, or the like, and as such should not be interpreted as a limiting factor of the apparatus 10.

The apparatus 10 is illustrated here being sized to contain three (3) luminescent golf balls 100; however, it is understood that the vertical dimension of the housing 20 may be varied to provide inclusion of any practical number of golf balls 100 without deviating from the concept and as such, should not be interpreted as a limiting factor of the apparatus 10.

Figure 3:
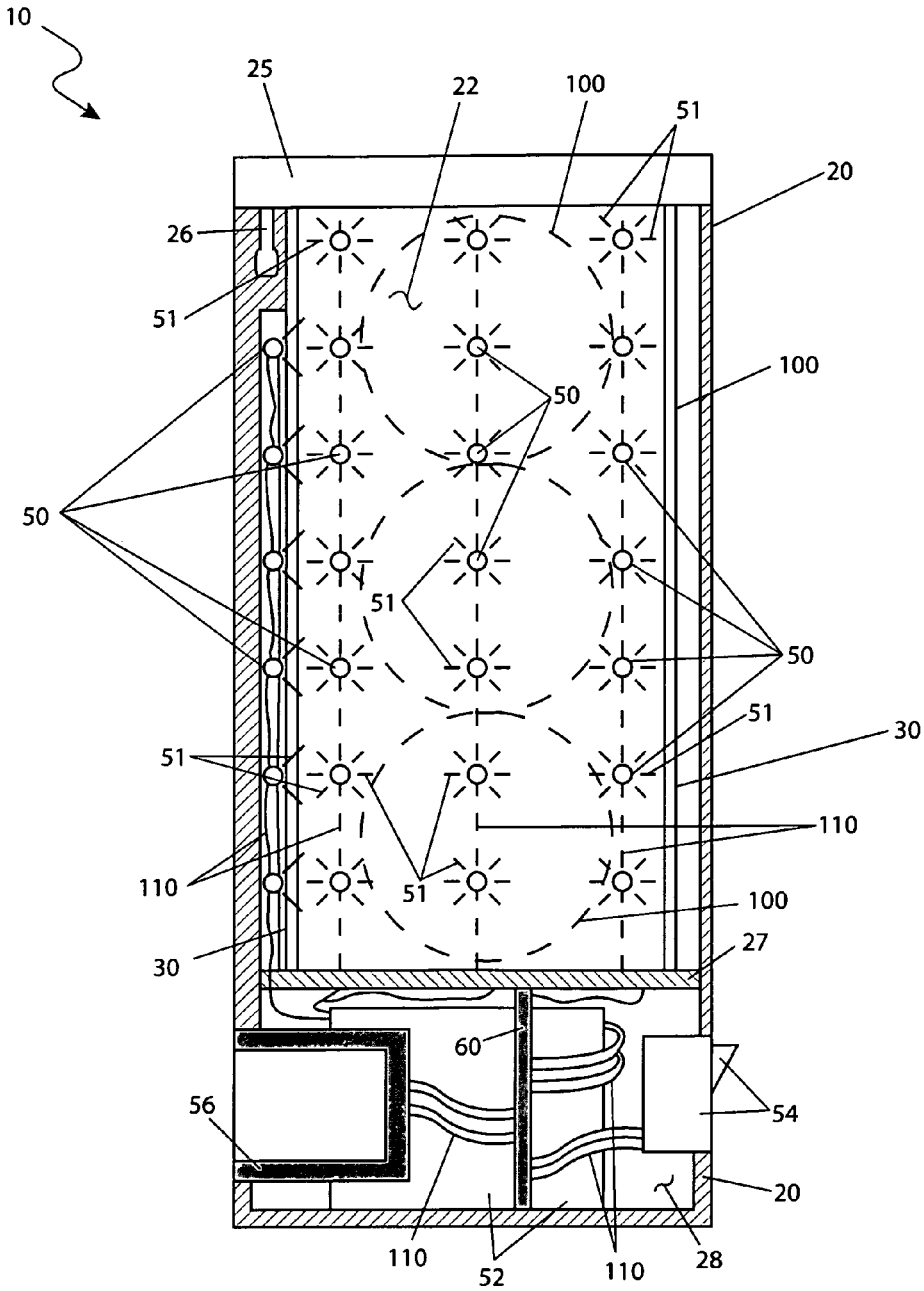
FIG. 3 is a section view of the luminescent golf ball recharging apparatus 10 taken along section line A-A of FIG. 2, according to a preferred embodiment of the present invention; and, FIG. 4 is an electrical block diagram depicting the major electrical components of the luminescent golf ball recharging apparatus 10, according to a preferred embodiment of the present invention.

Referring now to FIG. 3, a section view of the apparatus 10 taken along section line A-A of FIG. 2, according to a preferred embodiment of the present invention, is disclosed. The lid 25 comprises an octagonal-shaped member having a perimeter shape matching that of the housing 20, thereby forming an uninterrupted aesthetic profile of the apparatus 10 when in a closed state. The lid 25 is horizontally rotated around an integral downwardly extending post feature 26 being captivated within a mating hole molded into a top edge portion of the housing 20.

The housing 20 further comprises a floor panel 27 which provides a division between and physically separates the upper cavity 22 and a lower cavity 28. The lower cavity 28 provides protective, discreet containment of various electrical componentry necessary to control and power the lamps 50 and includes the battery 52, the battery access cover 65, the ON/OFF switch 54, the female DC receptacle 56, a terminal strip 60, and a plurality of interconnecting wires 110. While in use, the apparatus 10 receives power from the battery 52 to recharge the photoluminescent golf balls 100. When not in use, if a rechargeable battery 52 is installed, the battery 52 may be charged by plugging the male transformer plug 82 in to the female DC receptacle 56 as shown in FIG. 1.

Figure 4:
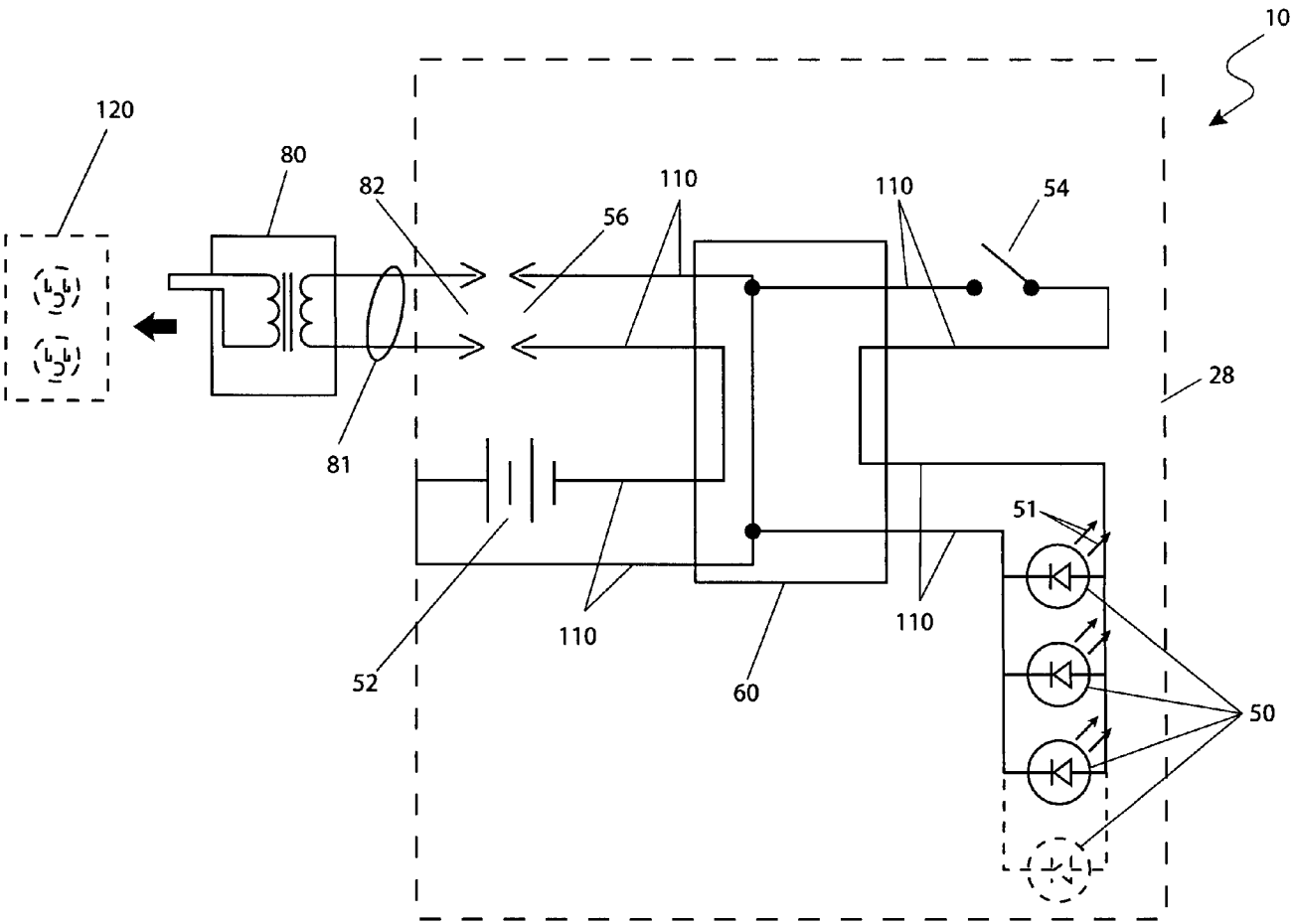

Referring now to FIG. 4, an electrical block diagram depicting the major electrical components of the luminescent golf ball recharging apparatus 10, according to a preferred embodiment of the present invention, is disclosed. Electrical power is supplied to the apparatus 10 via an internal rechargeable or disposable nine (9) volt battery 52 being in electrical communication with a pair of battery connecting terminals of a terminal strip 60 within the lower cavity 28. The terminal strip 60 in turn provides for the distribution of power via internal wiring 110 to a simple circuit comprising the ON/OFF switch 54 and to the lamps 50 which are located within the upper cavity 20. In the event a rechargeable battery 52 is installed, the transformer 80 may be used to provide a DC charging current to the rechargeable battery 52 via connection of the transformer 80 to a 120-volt outlet 120 and to the DC receptacle 56 located on the housing 20.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be utilized as indicated in FIGS. 1 and 2.

The method of installing and utilizing the apparatus 10 may be achieved by performing the following steps: procuring a model of the apparatus 10 having a desired size and appearance; installing a fresh battery 52 into the lower cavity 28 using the battery access cover 65; loading a desired number of luminescent golf balls 100 into the upper cavity 22; retaining the golf balls 100 within the upper cavity 22 by sliding the lid 25 over an open-end portion of the housing 20; activating the lamps 50 for a period of time by switching the ON/OFF switch 54 to the "ON" position, thereby recharging the luminescent characteristic of the contained golf balls 100 in anticipation of low light conditions; sliding the lid 25 to the side to expose and extract a golf ball 100 when needed; striking a glowing luminescent golf ball 100 in a normal manner; extracting another freshly recharged golf ball 100 to play subsequent holes of golf as needed; deactivating the lamps 50 by switching the ON/OFF switch 54 to the "OFF" position upon finishing a round of golf; and, benefiting from the improved visibility provided by the luminescent golf ball 100, thereby enabling a golfer to finish a round of golf in a low light condition using the present invention 10.

A user may also utilize the apparatus 10 to perform normal storage and dispensing of golf balls 100 during normal daylight hours without activating the lamp portions 50.

Additionally, if a rechargeable battery 52 is installed in the apparatus 10, a user may charge the battery 52 by performing the following steps: plugging the transformer 80 into a common duplex outlet 120; connecting the transformer plug portion 82 of the power cord 81 into the electrical receptacle portion 56 located on the housing 20; and, allowing a period of time for the battery 52 to become completely charged prior to remote operation of the apparatus 10 on a golf course.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A luminescent golf ball recharging apparatus comprising:

a generally cylindrical housing having an open top and a closed bottom defining an interior compartment for receiving at least one golf ball, said interior compartment further comprising:

an upper cavity for receiving said at least one golf ball;

a lower cavity for containing a plurality of electrical components; and, a thin planar floor panel separating said upper and lower cavities;

a planar lid pivotally attached to said housing, thereby providing access to said interior compartment;

a light source disposed within said interior compartment for providing illumination to said interior compartment, further comprising a plurality of lamps arranged in a plurality of parallel vertical rows around an interior of said upper cavity;

an electrical supply in electrical communication with said light source for powering said light source; and, a switch in electrical communication between said light source and said electrical supply for activating said light source;

wherein said illumination is absorbed by a photoluminescent material of said at least one golf ball.

2. The apparatus of claim 1, wherein said plurality of lamps further comprises a plurality of light-emitting diodes.

3. The apparatus of claim 2, wherein said electrical supply further comprises a battery disposed within said lower cavity;

wherein a bottom surface of said housing further comprises a removable battery cover for accessing said battery.

4. The apparatus of claim 2, wherein said battery further comprises a rechargeable cell; and, wherein a power transformer electrically interfaces with a direct current receptacle disposed on said housing for recharging said rechargeable cell.

5. The apparatus of claim 1, wherein said upper cavity further comprises an inner wall portion comprised of a light-diffusing translucent material for distributing said illumination from said light source; and, wherein said light source is disposed behind said inner wall portion.

6. The apparatus of claim 5, wherein said light source further comprises a plurality of lamps arranged in a plurality of parallel vertical rows around an interior of said upper cavity.

7. The apparatus of claim 6, wherein said plurality of lamps further comprises a plurality of light-emitting diodes.

8. The apparatus of claim 7, wherein said electrical supply further comprises a battery disposed within said lower cavity;

wherein a bottom surface of said housing further comprises a removable battery cover for accessing said battery.

9. The apparatus of claim 8, wherein said battery further comprises a rechargeable cell; and, wherein a power transformer electrically interfaces with a direct current receptacle disposed on said housing for recharging said rechargeable cell.

10. The apparatus of claim 9, wherein said upper cavity further comprises a longitudinal length suitable for containing a plurality of golf balls in a vertically stacked orientation.

11. A luminescent golf ball recharging apparatus comprising:

a generally cylindrical housing further comprising:

an open top for receiving at least one golf ball;

an upper cavity for containing said at least one golf ball;

a lower cavity for containing a plurality of electrical components;

a thin planar floor panel for separating said upper cavity and said lower cavity; and, a closed bottom;

a planar lid pivotally attached to an upper edge of said open top, thereby providing access to said interior compartment;

a plurality of lamps disposed on an interior of said upper cavity for providing illumination to said upper cavity;

a removable battery disposed within said lower cavity in electrical communication with said plurality of lamps for powering said plurality of lamps, wherein said housing closed bottom further comprises a removable battery cover for accessing said battery; and, a switch disposed on an exterior of said lower cavity in electrical communication between said plurality of lamps and said battery for activating said plurality of lamps;

wherein said housing further comprises a length and an octagonal transverse cross-section having eight planar side walls;

wherein said lid further comprises an octagonal perimeter;

wherein said upper cavity further comprises an inner wall portion comprised of a light-diffusing translucent material for distributing said illumination from said plurality of lamps;

wherein said plurality of lamps is disposed behind said inner wall portion; and, wherein said illumination is absorbed by a photoluminescent material of said at least one golf ball.

12. The apparatus of claim 11, wherein said battery further comprises a rechargeable cell; and, wherein a power transformer electrically interfaces with a direct current receptacle disposed on said lower cavity exterior for recharging said rechargeable cell.

13. The apparatus of claim 12, wherein said plurality of lamps further comprises a plurality of light-emitting diodes;

wherein said plurality of light-emitting diodes arranged in a plurality of parallel vertical rows equally spaced around an interior of said upper cavity.

14. The apparatus of claim 13, wherein said upper cavity further comprises a longitudinal length suitable for containing a plurality of golf balls in a vertically stacked orientation.

* * * * *